US010211532B2

(12) United States Patent
Foo

(10) Patent No.: US 10,211,532 B2
(45) Date of Patent: Feb. 19, 2019

(54) LIQUID-CRYSTAL RECONFIGURABLE MULTI-BEAM PHASED ARRAY

(71) Applicant: Senglee Foo, Ottawa (CA)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/689,817

(22) Filed: Aug. 29, 2017

(65) Prior Publication Data

US 2018/0316090 A1 Nov. 1, 2018

Related U.S. Application Data

(60) Provisional application No. 62/492,587, filed on May 1, 2017.

(51) Int. Cl.

| | |
|---|---|
| ***H01Q 3/44*** | (2006.01) |
| ***H01Q 3/26*** | (2006.01) |
| ***H01Q 19/06*** | (2006.01) |
| ***H01Q 3/34*** | (2006.01) |

(52) U.S. Cl.

CPC ..... *H01Q 3/44* (2013.01); *H01Q 3/2605* (2013.01); *H01Q 3/34* (2013.01); *H01Q 19/06* (2013.01)

(58) Field of Classification Search

USPC ..... 343/909, 911; 342/368, 371

See application file for complete search history.

(56) References Cited

U.S. PATENT DOCUMENTS 8,723,722 B2 * 5/2014 Fuller ..... F41H 13/0043 307/104
2009/0289863 A1 * 11/2009 Lier ..... H01Q 1/288 343/753
2010/0277398 A1 11/2010 Lam et al.

(Continued)

FOREIGN PATENT DOCUMENTS

CN 101971422 A 2/2011
CN 103094699 A 5/2013

(Continued)

OTHER PUBLICATIONS

Matthias Maasch et al, Voltage-Tunable Artificial Gradient-Index Lens Based on a Liquid Crystal Loaded Fishnet Metamaterial. IEEE Antennas and Wireless Propagation Letters, vol. 13, 2014, 4 pages.

(Continued)

*Primary Examiner* — Howard Williams

(57) ABSTRACT

A phased array antenna comprising a two dimensional array of lens enhanced radiator units, each radiator unit comprising: a radiator for generating a radio frequency (RF) signal; and a two dimensional phase variable lens group defining an aperture in a transmission path of the RF signal, the lens group comprising a two dimensional array of individually controllable lens elements enabling a varying transmission phase to be applied to the RF signal across the aperture of the lens group. Also, a unit cell of a lens element in a metamaterial sheet, the unit cell comprising a stack of cell layers, each cell layer comprising a volume of nematic liquid crystal with a controllable dielectric value enabling each cell layer to function as tunable resonator.

20 Claims, 5 Drawing Sheets

(56) References Cited

U.S. PATENT DOCUMENTS

| | | | | |
|---|---|---|---|---|
| 2011/0291907 | A1* | 12/2011 | Puzella | H01P 5/10 343/816 |
| 2012/0076498 | A1 | 3/2012 | Sayeed et al. | |
| 2014/0266897 | A1 | 9/2014 | Jakoby et al. | |
| 2018/0269576 | A1* | 9/2018 | Scarborough | H01Q 3/46 |

FOREIGN PATENT DOCUMENTS

| | | | |
|---|---|---|---|
| CN | 103975483 | A | 8/2014 |
| WO | 2017032184 | A1 | 3/2017 |

OTHER PUBLICATIONS

Seyed Mohamad et al, Wideband multi-beam antenna apertures using metamaterial-based superstrates. 2014 IEEE Antennas and Propagation Society International Symposium (APSURSI), Sep. 22, 2014, 2 pages.

Alexander Moessinger et al, Realization and Characterization of a 77 GHz Reconfigurable Liquid Crystal Reflectarray. 2009 13th International Symposium on Antenna Technology and Applied Electromagnetics and the Canadian Radio Sciences Meeting, Mar. 24, 2009 4 pages.

P. Deo and D. Mirshekar-Syahkal, "60 GHz Beam-Steering Slotted Patch Antenna Array Using Liquid Crystal Phase-shifters", Proceeding of the 2012 IEEE International Symposium on Antennas and Prop., pp. 1-2.

S. Christie, R. Cahill, N. Mitchell, Y. Munro, and A. Manabe, "Electronically scanned Rotman lens antenna with liquid crystal phase shifters", Electronics Letters, vol. 49, Issue 7, pp. 445-447, 2013.

C. Damm, M. Maasch, R. Gonzalo, and R. Jakoby, "Tunable Composite Right/Left-Handed Leaky Wave Antenna Based on a Rectangular Waveguide Using Liquid Crystals", 2010 IEEE MTT-S International Microwave Symposium, pp. 13-16.

P. Yaghmaee, O.H. Karabey, B. Bates, C. Fumeaux, and R. Jakoby, "Electrically Tuned Microwave Devices Using Liquid Crystal Technology", International Journal of Antennas and Propagation, vol. 2013, pp. 1-9, 2013.

L. Liu and R.J. Langley, "Liquid crystal tunable microstrip patch antenna", Electronics Letters, vol. 44, Issue 20, pp. 1179-1180, 2008.

N. Martin, P. Laurent, C. Person, P. Gelin, and F. Huret, "Patch Antenna Adjustable in Frequency Using Liquid Crystal", 33rd European Microwave Conference, pp. 699-702, 2003.

O.H. Karabey, A. Gaebler, S. Strunck, and R. Jakoby, "A 2-D Electronically Steered Phased-Array Antenna With 2×2 Elements in LC Display Technology", IEEE Transactions on Microwave Theory and Techniques, vol. 60, No. 5, pp. 1297-1306, May, 2012.

R. Marin, A. Mossinger, J. Freese, A. Manabe, and R. Jakoby, "Realization of 35 GHz Steerable Reflectarray Using Highly Anisotropic Liquid Crystal", IEEE Transactions on Antennas and Propagation Society International Symposium, pp. 4307-4310, 2006.

R. Marin, A. Mossinger, J. Freese, S. Muller, and R. Jakoby, "Basic Investigations of 35 GHz Reflectarrays and Tunable Unit-Cells for Beamsteering Applications", 2005 European Microwave Conference, vol. 3, 2005.

G. Perez-Palomino, J.A. Encinar, M. Barba, R. Dickie, P. Baine, R. Cahill, R. Florencio, and R.R. Boix, "Wideband Unit-Cell based on Liquid Crystals for Reconfigurable Reflectarray Antennas in F-band", Proceedings of the 2012 IEEE International Symposium on Antennas and Prog., pp. 1-2.

R. Cahill, J.A. Encinar, M. Arrebola, R. Simms, R. Dickie, V.F. Fusco, and N. Mitchell, "Recent Progress in Electronically Tunable Reflectarray Technology using Liquid Crystals", Proceedings of the 5th European Conference on Antennas and Prog. (EuCap), pp. 2866-2870, 2011.

S. Bildik, C. Fritzsch, A. Moessinger, and R. Jakoby, "Tunable Liquid Crystal Reflectarray with Rectangular Elements", German Microwave Conference Digest of Papers, pp. 1-4, 2010.

S. Bildik, S. Dieter, C. Fritzsch, M. Frei, C. Fischer, W. Menzel, and R. Jakoby, "Reconfigurable Liquid Crystal Reflectarray with Extended Tunable Phase Range", Proceedings of the 41st European Microwave Conference, pp. 1292-1295, 2011.

G. Perez-Palomino, M. Barba, J.A. Encinar, R. Cahill, R. Dickie, P. Baine, and M. Bain, "Design and Demonstration of an Electronically Scanned Reflectarray Antenna at 100 GHz Using Multiresonant Cells Based on Liquid Crystals", IEEE Transactions on Antennas and Propagation, vol. 63, No. 8, pp. 3722-3727, Aug. 2015.

G. Perez-Palomino, J.A. Encinar, M. Barba, R. Cahill, R. Dickie, P. Baine, and M. Bain, "Millimeter-wave Beam Scanning Antennas using Liquid Crystals", 9th European Conference on Antennas and Propagation (EuCap), 2015.

E. Doumanis, G. Goussetis, R. Dickie, R. Cahill, P. Baine, M. Bain, V. Fusco, J.A. Encinar, and G. Toso, "Electronically Reconfigurable Liquid Crystal Based Mm-Wave Polarization Converter," IEEE Transactions on Antennas and Propagation, vol. 62, No. 4, pp. 2302-2307, 2014.

* cited by examiner

LIQUID-CRYSTAL RECONFIGURABLE MULTI-BEAM PHASED ARRAY

RELATED APPLICATIONS

This application claims priority to and the benefit of U.S. Provisional Patent Application No. 62/492,587 filed May 1, 2017, the contents of which are incorporated herein by reference.

FIELD

The present disclosure relates to phased arrays. In particular, the present disclosure relates to a liquid-crystal reconfigurable metasurface multi-beam phased array.

BACKGROUND

Next generation wireless networks are likely to rely on higher frequency, lower wavelength radio waves, including for example the use of mm-wave technologies within the 24-100 GHz frequency band. At these frequencies, larger aperture and more directive antennas are likely to be used to compensate for higher propagation losses. Common technologies for large-aperture mm-wave antennas are lens and reflector antennas.

There has been growing interest in developing beam scanning antennas that rely on exploiting the anisotropy properties of liquid crystal to form a beam steerable reflector or reflectarray. Much of the interest has focused in either structures that employ a variable delay line using liquid crystal to achieve beam steerable phased array, or structures that operate in reflective mode using a large liquid crystal loaded reflectarray. Some attempts also have been made to use liquid crystal to form a tunable reflection polarizer. Although liquid crystal is potentially useful for many reconfigurable microwave devices, use of liquid crystal as a direct delay line tends to suffer from significant losses. As a result, operating liquid crystal as a direct delay line can only be limited to a small phased array. Forming a tunable reflective surface or reflectarray using liquid crystal has a disadvantage of a large F/D (Focal Distance/Aperture Size), which results in an antenna with an undesirably large profile. Furthermore, a tunable reflective surface also suffers relatively high loss at resonant frequency which results in low aperture efficiency.

Low profile, millimeter wave planar antennas which are capable of multi-beam transmission for multiuser MIMO (multiple-input, multiple-output) schemes and high-gain point-to-point transmission are needed for future 5G deployment. Accordingly, there is a need for a re-configurable, space-efficient lens antenna structures suitable for small wavelength applications.

SUMMARY

The present description describes example embodiments of an array structure of liquid crystal loaded metamaterial which in some applications enables construction of large, low-profile, forward transmitting phased arrays, without use of lossy phases shifters. In some examples, the described structure allows forming of multiple beams or an extremely directive high-gain beam using flexible hybrid beam forming methods.

According to one example aspect is a phased array antenna that includes a two dimensional array of lens enhanced radiator units. Each radiator unit includes a radiator for generating a radio frequency (RF) signal, and a two-dimensional phase variable lens group defining an aperture in a transmission path of the RF signal. The lens group has a two dimensional array of individually controllable lens elements enabling a varying transmission phase to be applied to the RF signal across the aperture of the lens group.

In example embodiments, the lens groups are formed from a metamaterial sheet, and conductive wall isolate adjacent radiator units from each other. In some examples the antenna includes a control circuit configured to enable the radiators units to operate in a MIMO mode in which the radiator units operate to form multiple concurrent independent beams and a point-to-point mode in which the radiator units operate collectively to form a single high-gain directive beam or multiple optimally shaped beams.

In example embodiments, the aperture of each lens group is greater than twice a minimum operating wavelength $\lambda$ of the RF signal and in some configurations the antenna of claim 5 wherein adjacent lens groups are spaced within one and one half the wavelength $\lambda$ of each other. In some examples, each lens element has an aperture size of approximately half of the wavelength $\lambda$.

In at least some configurations, a plurality of control conductors are provided about a perimeter each radiator unit for providing a unique configurable control voltage to each of the lens elements within the radiator unit.

In some example embodiments, each lens element comprises at least one unit cell, each unit cell comprising a stack of cell layers, each cell layer comprising a volume of nematic liquid crystal with a controllable dielectric value enabling each cell layer to function as tunable resonator. Each lens element may include a two dimensional array of the unit cells.

In some examples, each cell layer in a unit cell comprises: first and second double sided substrates defining an intermediate region between them, the first substrate having a first microstrip patch formed on a side thereof that faces the second substrate, the second substrate having a second microstrip patch formed on a side thereof that faces the first substrate, and the liquid crystal is located in a liquid crystal embedded substrate between the first microstrip patch and the second microstrip patch in the intermediate region, with the first microstrip patch of each cell layer electrically connected to a common DC ground and the second microstrip patch of each cell layer electrically connected to a common control voltage source.

In some configurations, the first microstrip patch of each cell layer is electrically connected to the common DC ground via a first conductive element extending through the first substrate to a first conductive wire located on an opposite side of the first substrate than the first microstrip patch. The second microstrip patch of each cell layer is electrically connected to the common control voltage source via a second conductive element extending through the second substrate to a second conductive wire located on an opposite side of the second substrate than the second first microstrip patch, and the first wire and the second wire are substantially RF transparent to the RF signal passing through the cell layer. The first wire and the second wire may each part of a respective first gridded mesh wire and second gridded mesh wire that extend across the lens element that comprises the unit cell. In some examples, adjacent cell layers in a unit cell are bonded together by non-conductive adhesive.

According to a further aspect is a method of transmitting RF signals, comprising: providing a phased array antenna having a two dimensional array of lens enhanced radiator units, each radiator unit comprising: a radiator for generating a radio frequency (RF) signal; and a lens group defining an aperture in a transmission path of the RF signal, the lens group comprising a two dimensional array of individually controllable lens elements enabling a varying transmission phase to be applied to the RF signal across the aperture of the lens group; generating RF signals at the radiators; and applying control voltages to the lens groups to control a transmission phase of the lens elements across each of the radiator units.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Example embodiments are described below of a low profile, electronically reconfigurable phased array that is implemented using electrostatically controllable liquid-crystal-loaded metamaterial. In example embodiments the phased array structure is comprised of multiple reconfigurable lens-enhanced radiators. In at least some applications, use of lens-enhanced radiating elements can increase the effective aperture of each radiator, and thereby reduce overall complexity of the phased array. Using a liquid-crystal-loaded metamaterial lens can allow a transmission phase of each sub-array across a phased array aperture to be electronically tuned independently. The array can be fed in groups to allow flexible hybrid beam forming for multiple beams, or can be fed with coherent phase across the aperture to form a highly directive steerable beam. Use of multiple feeds with smaller sub-arrays can reduce overall array profile since focal distance from the lens is much smaller with smaller sub-array implemented lenses. The example embodiments described herein can, in some configurations, provide a versatile, low profile, high aperture efficiency, reconfigurable phased array for anticipated 5G deployment.

A metasurface can be used to provide tailored transmission characteristics for EM waves using a patterned metallic structure. A reconfigurable metasurface can be achieved by loading a metasurface with nematic liquid crystal. The metasurface makes use of the tunable dielectric anisotropy of liquid crystals to realize phase-tunable flat metasurface transmission elements. By varying low frequency modulated control voltage signals, including DC voltages, on microstrip patches of unit cells, effective dielectric constant, and therefore the phase differential at various locations of the metasurface can be changed as desired.

In example embodiments, a flat metasurface array forms an array of lens groups, with each lens group including multiple LC tunable cells. Each LC tunable cell includes a stack of cell layers, with each cell layer loaded with liquid crystal that is embedded between opposing microstrip patches. The effective dielectric constant between the two microstrip patches of the layers at each unit cell can be tuned by varying electrostatic field between the patches due to the anisotropy of the liquid crystal.

Figure 1:
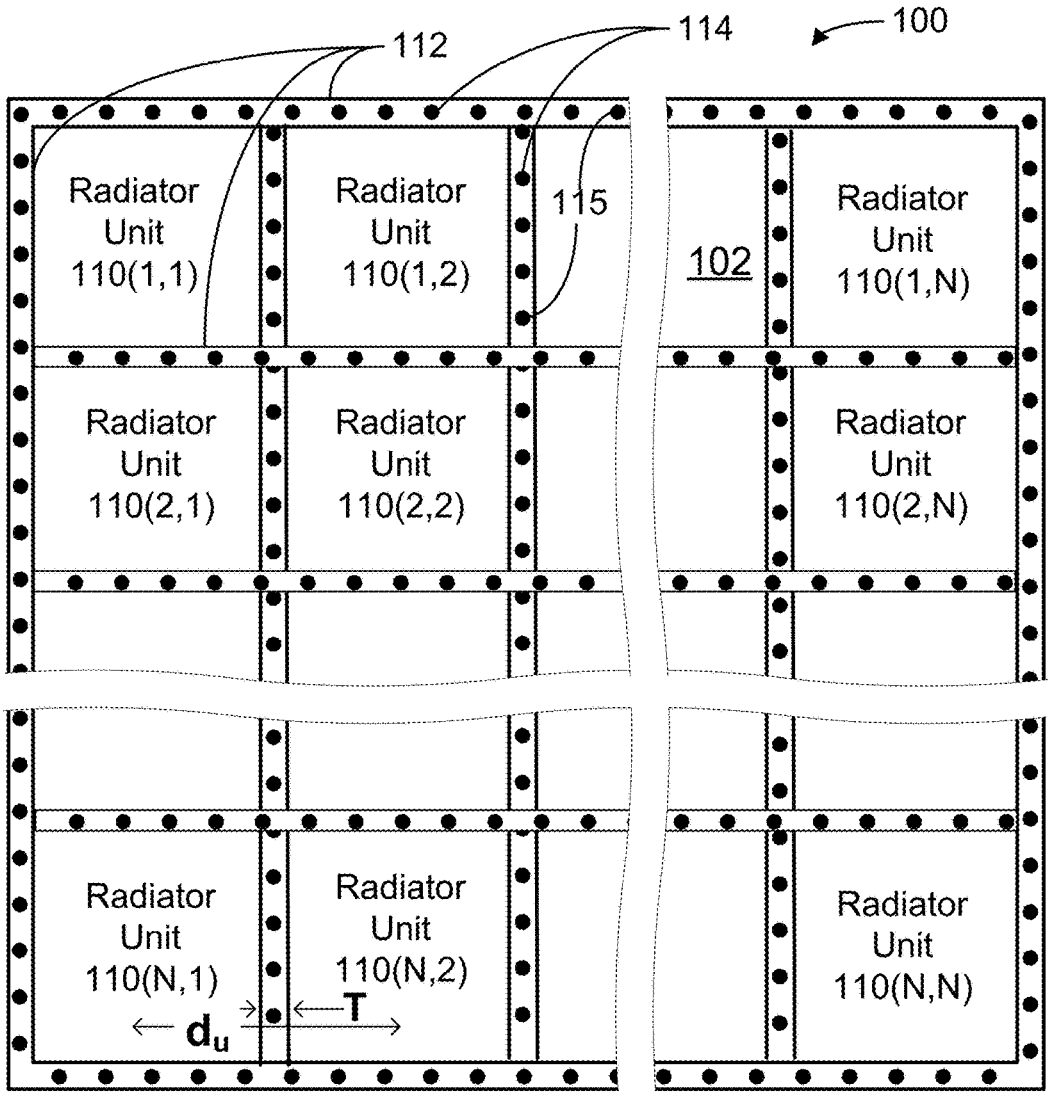
FIG. 1 is a top plan view of a liquid crystal (LC) tunable metasurface multi-beam phased array antenna, according to example embodiments.
Figure 2:
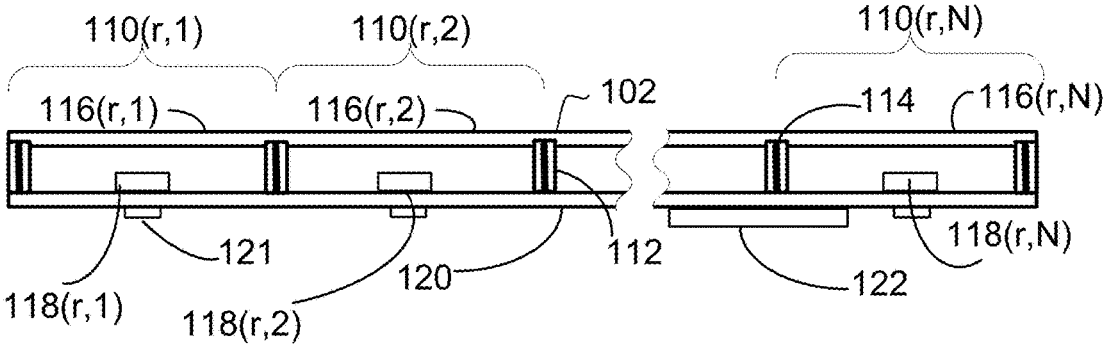
FIG. 2 is a schematic sectional view of the LC tunable metasurface multi-beam phased array antenna of FIG. 1.

In this regard, schematic plan and sectional views of an example embodiment of a liquid-crystal (LC) reconfigurable multi-beam phased array 100 are shown in FIGS. 1 and 2, respectively. The array 100 includes an LC loaded tunable metamaterial lense sheet 102 that takes the form of multiple patterned metallic sheet layers spaced apart from and parallel to a sheet-like feed and support structure, which in the illustrated embodiment is a printed circuit board (PCB) structure 120. The array 100 implements an N×N periodic array of individually reconfigurable lens-enhanced radiator units 110(*r,c*), where $1 \le r \le N$ and $1 \le c \le N$. Each lens-enhanced radiator unit 110(*r,c*) includes a corresponding lens group 116(*r,c*) and a corresponding radiator 118(*r,c*). Each lens group 116(*r,c*) is formed from a respective portion of LC loaded tunable metamaterial lens sheet 102 and is spaced apart from its corresponding radiator 118(*r,c*), which is supported by the feed PCB structure 120. The outer perimeter of each lens enhanced radiator unit 110(*r,c*) is surrounded by metallic walls 112 that extend between the feed PCB structure 120 and the metamaterial lens sheet 102. Additionally, each radiator unit 110(*r,c*) is also surrounded by a series of spaced apart conductive elements such as pins 114, 115 that are located adjacent or within metallic walls 112 and extend between the feed PCB structure 120 and the metamaterial lens sheet 102. Pins 114 are control pins that are electrically isolated from metallic walls 112 and used to provide control voltages to respective lens groups 116(*r,c*), and pins 115 are electrically grounded to provide a common DC ground for respective lens groups 116(*r,c*). Metallic walls 112 can all be electrically connected to the common DC ground. The metallic walls surrounding each of the radiator units 110(*r,c*) provide beam pattern control and shielding of the control voltage pins 114, and can also minimize coupling and interference between the radiator units 110(*r,c*).

Figure 3:
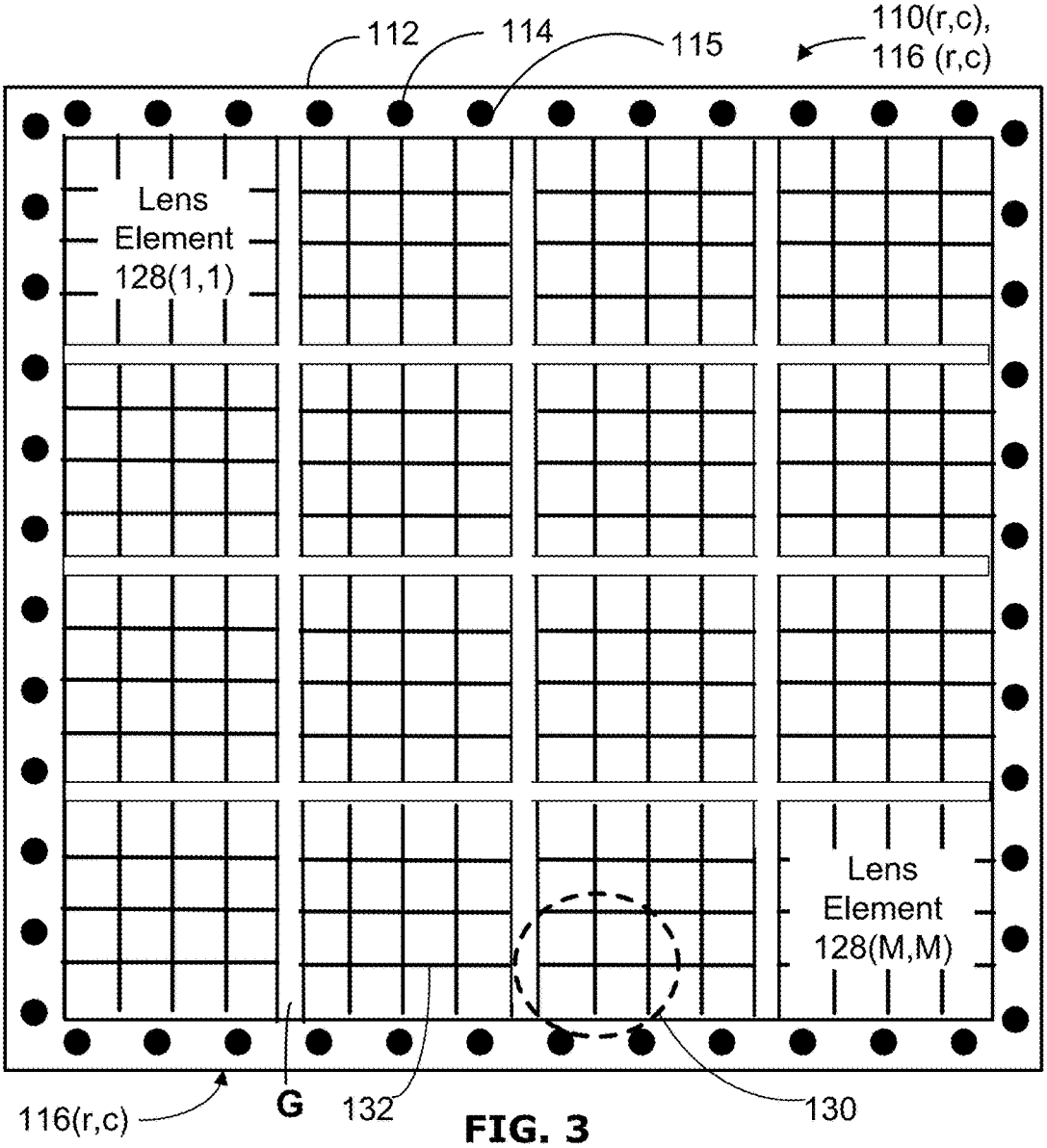
FIG. 3 is an enlarged top plan view of a radiator unit of the LC tunable metasurface multi-beam phased array antenna of FIG. 1.
Figure 4:
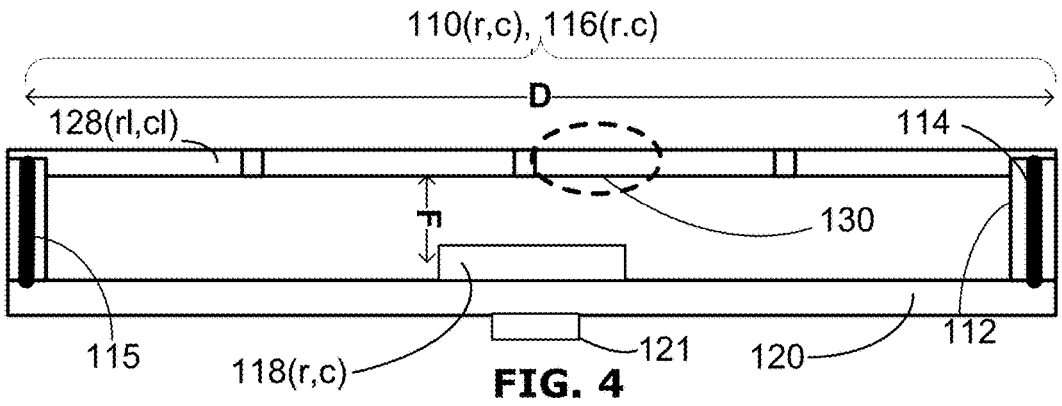
FIG. 4 is a schematic sectional view of the radiator unit of FIG. 3.

FIGS. 3 and 4 schematically illustrate one radiator unit 110(*r,c*) in greater detail. As noted above, each radiator unit 110(*r,c*) comprises an LC loaded metamaterial lens group 116(*r,c*) and a radiator 118(*r,c*). Each lens group 116(*r,c*) has an aperture size D (FIG. 4) that is greater than twice an intended minimum operating wavelength $\lambda$ of the array 100 (i.e. $D>2\lambda$), and the radiator 118(*r,c*) is located at the focal plane of the lens group 116(*r,c*), with the focal distance between the radiator 118(*r,c*) and the lens group 116(*r,c*) denoted as F in FIG. 4. In example embodiments, the periodic spacing $d_u$ (see FIG. 1) of radiator units 110(*r,c*) is $\lambda/2<d_u<k-\lambda$, where k is a constant greater than 0.5 and less than 1 that is determined based on the required maximum array scan angle. Accordingly, internal metallic boundary walls 112 within array 100 have a thickness $T<\lambda/4$.

When compared to a lens antenna structure having a single lens and a single radiating element, the N×N array structure of FIGS. 1-4 can have a substantially reduced overall height as the focal distance is reduced by a factor of N for a fixed F/D ratio α. For example, where Fi and Di represent the focal distance and aperture size of the array 100 of lens enhanced radiator units 110 and F and D represent the focal distance and aperture size of a single radiating unit:

$$D_i = \frac{D}{N}, \frac{F_i}{D_i} = \frac{F}{D} = a$$

$$F_i = a * D_i = a * \frac{D}{N} = \frac{F}{N}$$

As seen in FIGS. 3 and 4, in example embodiments, each LC loaded metamaterial lens group 116(*r,c*) is further divided into an M×M array of lens elements 128(*rl,cl*), where 1≤rl≤M and 1≤cl≤M. In example embodiment, each lens element 128(*rl, cl*) is individually controllable and has a lens element aperture size of about λ/2 for best phased array performance. Each lens element 128(*rl,cl*) is formed from a plurality of LC-loaded true-time-delay (TDU) metamaterial unit cells 130. In example embodiments the number ($N_c$) of unit cells 130 included in each lens element 128(*rl, cl*) is approximately $N_c$<k*λ/(2d) where k>1 is a constant that is determined based on the desired maximum scan angle of the array 100 and d is the unit cell size.

Control voltages for LC layers of the units cells 130 are connected through wire grid layers 132 (FIG. 3) that extend through the lens element 128(*rl,cl*). These wire grid layers 132 are separated by a small gap G between adjacent lens elements 128(*rl,cl*) to allow independent control of transmission phase for each lens element, which results in a small edge effect within each lens element 128(*rl,cl*). Consequently, it is desirable to have a large number Nc of TDU unit cells 130 in each lens element 128(*rl,cl*) to minimize this edge effect, which can be achieved by using TDU unit cells 130 that are the smallest possible size. However, use of too small a unit cell size may also reduce the overall aperture efficiency of the lens element 128(*rl,cl*) due to the loss in transmission efficiency. For example, a TDU unit cell 130 size of d=1.5 mm operating at 39 GHz allows a lens element 128(*rl,cl*) with 3×3 group of cell units 130 a maximum array scan angle of up to approximately 30 degrees. A TDU unit cell 130 size of d=1.4 mm operating at 39 GHz will allow a lens element 128(*rl,cl*) with a 4×4 grouping of cell units 130 a maximum array scan angle of up to approximately 27 degrees.

To summarize the architecture of reconfigurable phased array 100 described above, array 100 is divided up into an N by N array of lens enhanced radiator units 110(*r,c*). Each radiator unit 110(*r,c*) is further divided into a M by M array of lens elements 128(*rl,cl*). Each lens element 128(*rl,cl*) includes a plurality of unit cells 130, which can also be arranged in a 2-dimensional array. In example embodiments, each radiator unit 110(*r,c*) has a group aperture size of D and includes a lens group 116(*r,c*) positioned at focal distance F above a respective radiator 118(*r,c*). Each lens enhanced radiator unit 110(*r,c*) has a surrounding metallic wall 112 that houses grounding pins 115 and control pins 114. In example embodiments, a control circuit 122 (FIG. 2) is provided on feed PCB structure 120 for controlling the operation of array 100. The control circuit 122 may for example include one or more integrated circuit control chips and associated active and passive elements that are configured to enable the array 100 to function as a reconfigurable phased array in the manner described herein. In example embodiments the feed PCB structure 120 includes a plurality of low frequency (which may for example include DC) signal paths electrically connecting the control circuit 122 to the control pins 114 of the radiator units 110(*r,c*) in an addressable manner. The feed PCB structure 120 also includes a ground plane connected by ground paths to ground pins 115 and the metallic walls 112 surrounding the radiator units 110(*r,c*). Additionally, the feed PCB structure 120 includes RF feed interfaces 121 for applying respective RF signals to each of the radiators 118(*r,c*).

In example embodiments, the control circuit 122 and control pins 114 are configured to enable different control voltages to be provided to each lens element 128(*rl,cl*) within a radiator unit 110(*r,c*), enabling the transmission phase to be controlled to about a λ/2 resolution across the M by M elements of the lens group 116(*r,c*). In such example embodiments, the unit cells 130 within each lens element 128(*rl,cl*) may all be tied to a common control pins 114 to reduce circuit complexity. In some examples, the number of unit cells 130 that make up a lens element 128(*rl,cl*) can be reduced to increase resolution if required—for example in some embodiments a lens element 128(*rl,cl*) may include only a single unit cell 130.

In example embodiments, the array 100 can be used in different operational modes. For example, in a point-to-point operational mode, the transmission phases of lens elements 128(*rl, cl*) of radiator units 110(*r,c*) can be controlled collectively across the array 100 to form a lens aperture with coherent phase using hybrid beam forming to provide a highly directive high-gain beam for point-to point communications. In a MIMO operational mode, the radiator units 110(*r,c*) can be operated individually or as groups of units to implement multi-beam or shaped beams for multi-user MIMO communications.

Figure 5:
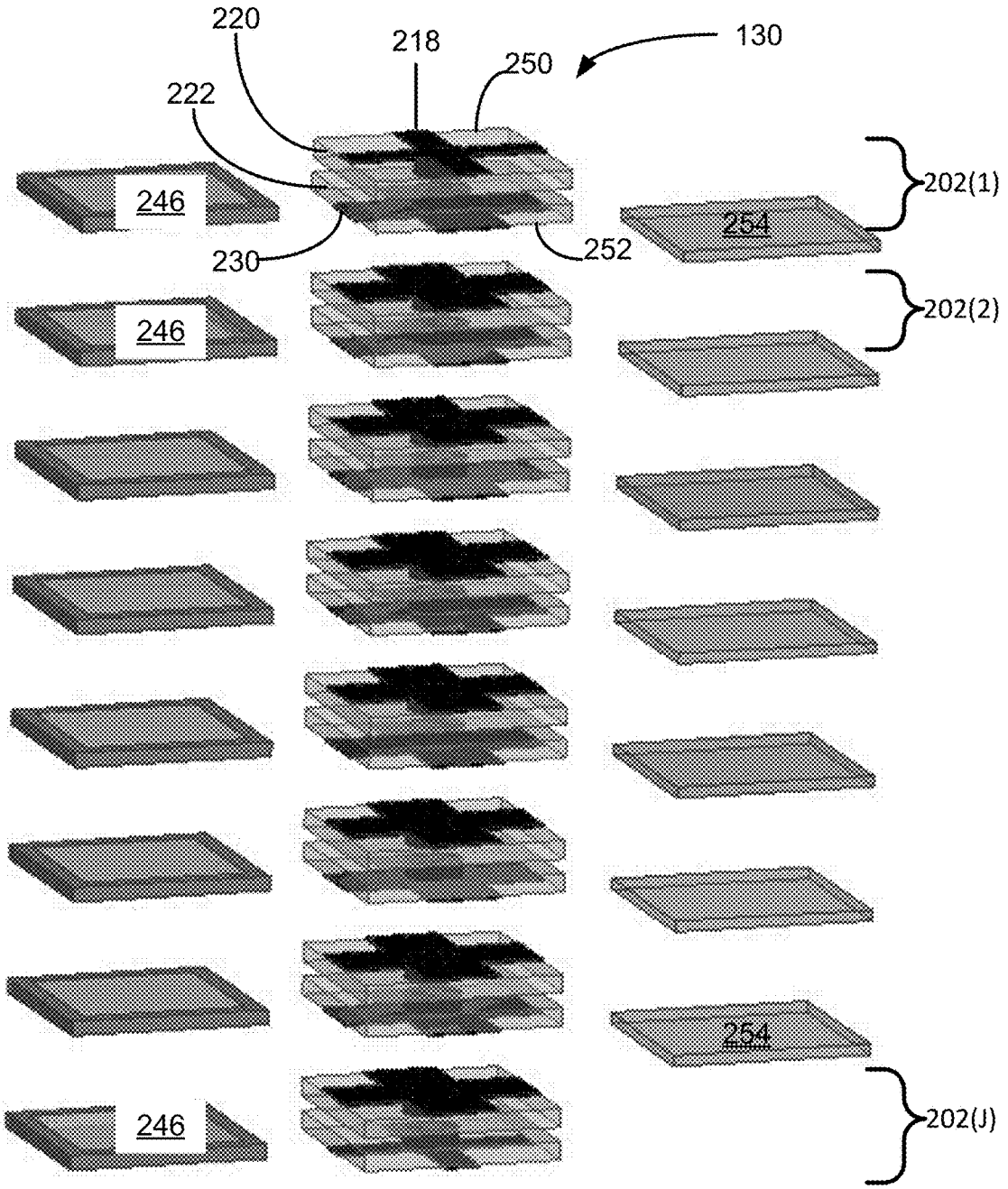
FIG. 5 is an exploded perspective view of a tunable LC unit cell of the radiator unit of FIG. 3.
Figure 6:
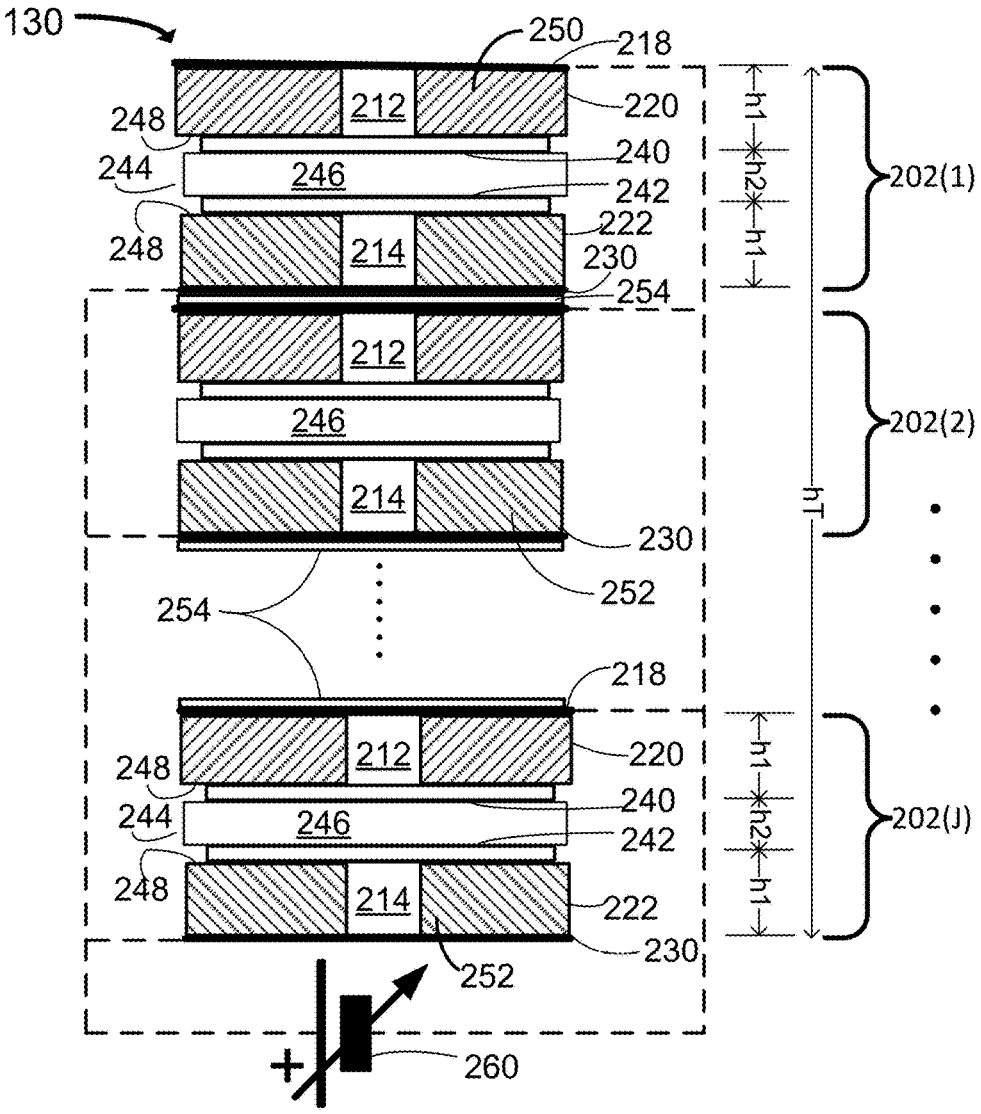
FIG. 6 is a side cross-section view of the tunable LC unit cell of FIG. 5.

An example of a unit cell 130 will now be described in greater detail with reference to FIGS. 5 to 8. In example embodiments, metamaterial lens sheet 102 is formed from multiple sheet layers of materials of finite thickness that each include substrate layers, micropatch layers, wire mesh layers, bonding layers, and LC embedded substrate layers. Metamaterial lens sheet 102 forms a lens group 116(*r,c*), which is divided into individually controllable lens elements 128(*rl,cl*) that each include at least one multi-layer LC unit cell 130. FIGS. 5 and 6 respectively show an exploded perspective view and a side sectional view of a representative unit cell 130, and FIGS. 7 and 8 respectively show a top view and a bottom view of a unit cell 130. In the illustrated embodiment, unit cell 130 is a multi-layer stack of a number (J) of LC-loaded cell layers 202(*i*) (where 1≤i≤j). Each cell layer 202(*i*) includes: (a) spaced apart substrate layers in the form of an upper double-sided printed circuit board (PCB) 220 and a lower double sided PCB 222; and (b) a sub-operating wavelength layer of electronically tunable liquid crystal (LC) embedded substrate 246 located between the upper and lower PCBs 220,222. In the present description "upper", "top, "lower", and "bottom" are used relative to the unit radiator 118(*r,c*), with "upper" and "top" being relatively further from the unit radiator 118(*r,c*) than "lower" and "bottom".

Figure 7:
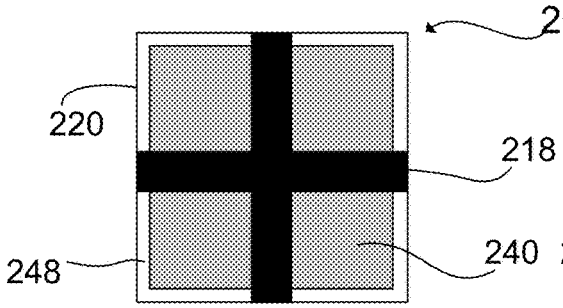
FIG. 7 is a top plan view the tunable LC unit cell of FIG. 3.

In each cell layer 202(*i*), upper PCB 220 has a central non-conductive substrate layer 250 (shown in cross-hatch in FIG. 6). A ground wire 218 in the form of intersecting conductive lines forms the top layer of the PCB 220. In some examples, ground wire 218 is part of wire mesh layer 132 that extends across the lens element 128(*rl,cl*). A conductive microstrip patch 240, surrounded by an insulating slot or gap 248, forms the bottom layer of the PCB 220. In the illustrated embodiment, microstrip patch 240 is electrically connected by a conductive plated-through-hole (PTH) via 212 that extends from the center of the patch 240 through the PCB 220 substrate layer to a respective intersection point of ground mesh wire 218. FIG. 7 shows a top view of mesh wire 218 and microstrip patch 240 sub-layers of PCB 220 (the substrate layer 250 of PCB 220 is not shown in FIG. 7). In example embodiments, PTH via 212 may be provided by forming and plating a hole through the PCB 220 substrate layer, microstrip patch 240 may be formed from etching gaps 248 from a conductive layer on the lower surface of PCB 220, and gridded mesh wire 218 may be similarly formed by etching a conductive layer to form conductive traces or lines on the upper layer of PCB 220.

Figure 8:
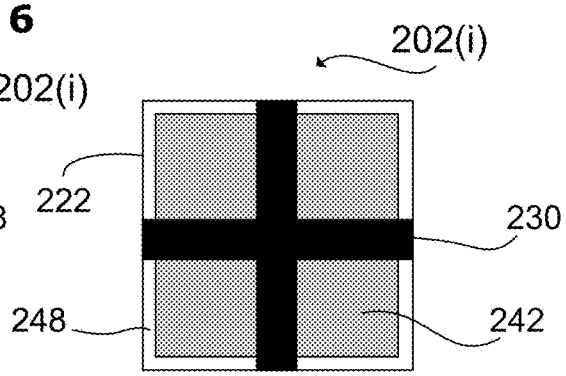
FIG. 8 is a bottom plan view the tunable LC unit cell of FIG. 3.

In example embodiments, lower PCB 222 is similar in construction to upper PCB 220 but is inverted. In this regard, lower PCB 222 has a central non-conductive substrate layer 252 (shown in cross-hatch in FIG. 6). A control wire 230 in the form of intersecting conductive lines forms the bottom layer of the PCB 222. In some examples, control wire 230 is part of a wire mesh layer that extends across the lens element 128(*rl,cl*). A conductive microstrip patch 242, surrounded by an insulating slot or gap 248, forms the top layer of the PCB 222. In the illustrated embodiment, microstrip patch 242 is electrically connected by a conductive plated-through hole (PTH) via 214 that extends from the center of the patch 242 through the PCB 221 substrate layer to a respective intersection point of mesh control wire 230. FIG. 8 shows a bottom view of the mesh control wire 230 and microstrip patch 242 sub-layers of PCB 222 (the substrate layer 252 of PCB 222 is not shown in FIG. 8).

As described above, the upper and lower PCBs 220, 222 of cell layer 202(*i*) are located in spaced opposition to each other with LC embedded substrate 246 located between them. In particular, the upper PCB microstrip patch 240 and the lower PCB microstrip patch 242 align with each other to form a region 244 which contains a volume of LC embedded substrate 246.

Each of the cell layers 202(*i*) in a unit cell 130 is secured to and electrically isolated from the adjacent cell layers 202($i\pm1$) by a bonding layer 254 (which may for example be a thin film adhesive). As illustrated in FIG. 6, in an example embodiment the upper mesh wire 218 of each cell layer 202(*i*) is electrically connected to a DC ground, and the lower mesh wire 230 of each cell layer 202(*i*) is electrically connected to a control signal source 260, such that the all the cell layers 202(*i*) in the unit cell 130 are connected in parallel to the same control signal source 260. In an example embodiment, PCBs 220 and 222 are relatively thin to facilitate proper frequency and delay responses of the lens cell unit, having a thickness $h1<\lambda/20$ and the LC embedded substrate 246 in cell region 244 has a thickness h2 that is generally less than 100 micron to optimize liquid crystal response to the electrostatic field applied between the opposed microstrip patches 240 and 242).

Accordingly, as can be appreciated from FIG. 6, each unit cell 130 includes a stack of cell layers 202(*i*), with each cell layer having a volume of tunable liquid crystal (LC embedded substrate 246) located in region 244 between an upper conductive microstrip patch 240 and a lower conductive microstrip patch 242. The upper conductive microstrip patch 240 of each of the cell layers 202(*i*) is connected by a respective conductive path (PTH via 212 and upper mesh wire 218) to a common DC ground. The lower conductive microstrip patch 242 each of the cell layers 202(*i*) is connected to a control terminal (PTH via 214 and lower mesh wire 230) to a control voltage from an adjustable DC/low frequency voltage source 160. In some embodiments, the cell polarities may be flipped, with upper conductive microstrip patch 240 connected to the DC/low frequency voltage source 160 and the lower conductive microstrip patch 242 connected to ground.

The collective J cell layers 202(*i*) of unit cell 130 effectively form a set of J resonators in cascade, or an $J^{th}$ order band-pass filter in series, with a tunable transmission phase. The EM transmission phase of each unit cell 130 can be varied electronically by varying the control voltage signal applied by control signal source 260 (which is controlled by control circuit 122 in example embodiments). In example embodiments, control signal source 260 is configured to apply a low-frequency modulated control voltage signal, including a DC voltage control signal. The transmission phase of each cell layer 202(*i*) depends on geometry of the cell layers and dielectric properties of the materials used in the PCBs 220, 222. The total tunable phase range of the unit cell 130 depends on the total number (J) of cell layers 202(*i*) and the intended operating frequency bandwidth. In example embodiments the number (J) of cell layers 202(*i*) is selected so that for a given frequency bandwidth the number of layers is sufficient to at least provide a total tunable phase range of 360 degrees for a Fresnel lens antenna. In the example shown in FIG. 5, the number of cell layers is J=8, however other numbers of layers could be used. In example embodiments, the microstrip patches 240, 242 have rectangular surfaces (for example square) having a maximum normal dimension that is less than ¼ of the minimum intended operating wavelength λ, however other microstrip patch configurations could be used.

Figure 9:
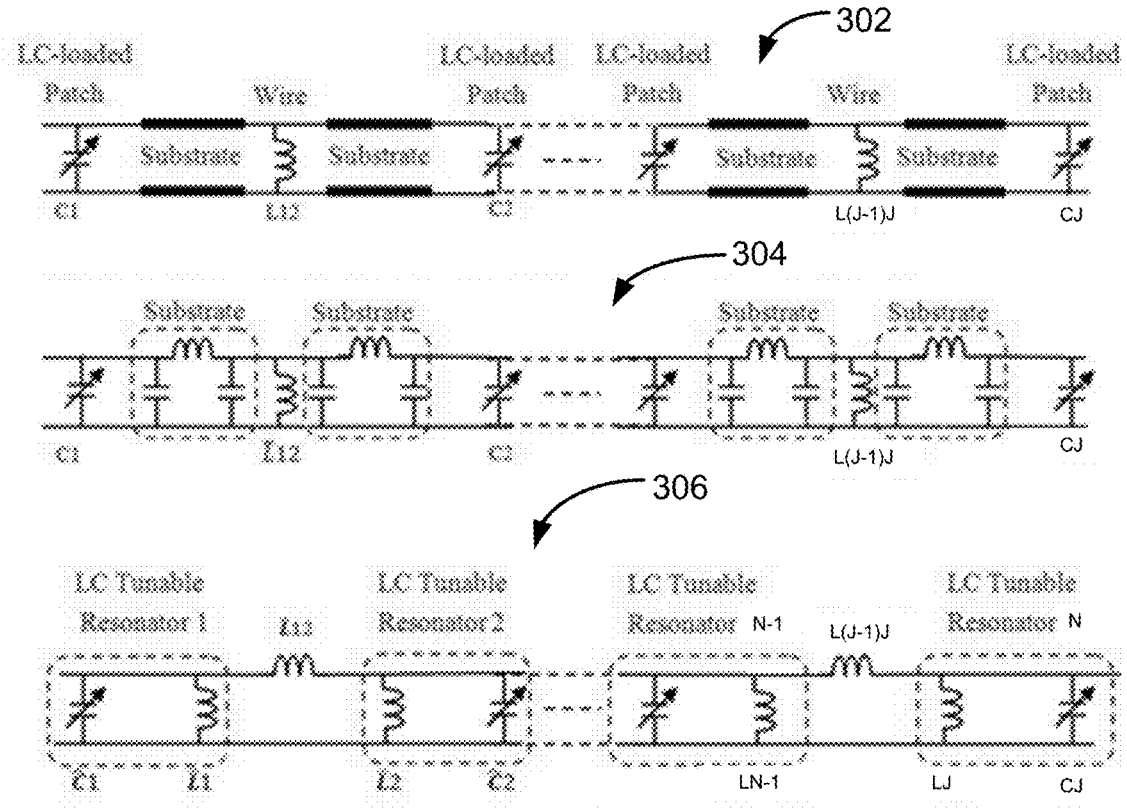
FIG. 9 shows equivalent circuit representations of the LC unit cell of FIG. 3.

The configuration and size of the patches 240,242 and gauge of the mesh wires 218, 230 are determined by the desired frequency response of the lens provided by the unit cell 130. The size of PTH vias 212, 214 and wires 218,230 are also selected to make the control lines of the unit cell 130 substantially RF transparent to EM waves passing through the unit cell 130 without disturbing the frequency response of the lens. The properties of the mesh wire 218, 230, PTH vias 212, 214, substrate layers 250, 252 and bonding layers 254 are collectively selected to optimize the EM transmission properties of the unit cell 130 and minimize any extraneous impact on the cell transmission phase beyond the controllable impact of the tunable LC layers 246. In this regard, FIG. 9 shows the equivalent circuits for the J layer LC unit cell 130. Circuit 302 is an equivalent circuit for the LC unit cell 130 at a normal incidence angle. Circuit 304 is an equivalent circuit for LC unit cell 130 as an equivalent transmission line model. Circuit 306 is an equivalent circuit for LC unit cell 130 represented as a plurality of LC tunable filter resonators.

As can be appreciated from the equivalent circuits of FIG. 9, ground and control mesh wires 218, 230 can have an inductive impact on the transmission phase. Accordingly, in some example embodiments, as graphically illustrated in FIG. 5, the dimensions of the mesh wires 218, 230 may be varied throughout the different cell layers 202(*i*) of the unit cell 130 to achieve desired cell transmission properties. In some examples, simulations are performed to select an optimal set of component properties for unit cells 130 to enable optimized RF transmission for a target bandwidth, wavelength and tunable phase range.

In example embodiments, layers of PCB's 220, 222 with periodic micropatches 240, 242 extend across the entire metamaterial lens 102 forming all the unit cells 130. During assembly, LC embedded substrate 246 is placed between the PCB's 220, 222 of each cell layer 202(*i*) which can then be secured together at a structured distance, with adjacent PCB pairs 220, 222 secured by bonding layers 254. In example embodiments, the liquid crystal of LC embedded substrate 246 is nematic liquid crystal that has an intermediate nematic gel-like state between solid crystalline and liquid phase at the intended operating temperature range of the metasurface lens 102. Examples of liquid crystal include, for example, GT3-23001 liquid crystal and BL038 liquid crystal from the Merck group. Liquid crystal 146 in a nematic state possesses dielectric anisotropy characteristics at microwave frequencies, whose effective dielectric constant may be adjusted by setting different orientations of the molecules of liquid crystal 246 relative to its reference axis.

At microwave frequencies, the liquid crystal of LC embedded substrate 246 may change its dielectric properties due to different orientations of the molecules caused by application of electrostatic field between microstrip patches 240 and 242. Thus, the effective dielectric constant between the microstrip patches 240 and 242 in the cell layers of each unit cell 130 can be tuned by varying the DC voltage applied to the patches 242 of each unit cell 130, allowing the transmission phase of unit cells 106 to be controlled.

As indicated above, in example embodiments, all of the unit cells 130 within each lens element 128(*rl, cl*) are electrically connected to the same control voltage such that the EM transmission phase of the unit cells 130 of each lens element 128(*rl,cl*) is collectively controlled as a block. Each lens element 128(*rl,cl*) is individually connected to independent control voltage, enabling the transmission phase to be varied across the M by M array of lens elements 128(*rl,cl*) that make up a lens group 116(*r,c*) of a radiator unit 110(*r,c*). With proper control voltage distribution to the lens elements 128(*rl,cli*) across its aperture, each lens group 116(*r,c*) can be configured to implement a 2D distributed spatial phase shifter which produces a beam from a radiator 118(*r,c*) with a desired shape or which uses a transmitted pattern with progressive phase distribution across its aperture to form a directive beam. In an alternative operational mode, an even more directive beam can be formed by summing the outputs of all the radiator units 110(*r,c*) with proper phase continuities between the radiator units 110(*r,c*), enabling an extremely high gain, low profile 2D beam steerable phased array.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although specific sizes and shapes of cells 130 are disclosed herein, other sizes and shapes may be used.

Although the example embodiments are described with reference to a particular orientation (e.g. upper and lower), this was simply used as a matter of convenience and ease of understanding in describing the reference Figures. The metasurface may have any arbitrary orientation.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. A phased array antenna comprising:

a two dimensional array of lens enhanced radiator units, each radiator unit comprising:

a radiator for generating a radio frequency (RF) signal;

a two-dimensional phase variable lens group defining an aperture in a transmission path of the RF signal, the lens group comprising a two dimensional array of individually controllable lens elements enabling a varying transmission phase to be applied to the RF signal across the aperture of the lens group.

2. The antenna of claim 1 wherein the lens groups are formed from a metamaterial sheet.

3. The antenna of claim 1 comprising conductive walls isolating adjacent radiator units from each other.

4. The antenna of claim 1 comprising a control circuit configured to enable the radiators units to operate in a MIMO mode in which the radiator units operate to form multiple concurrent independent beams and a point-to-point mode in which the radiator units operate collectively to form a single high-gain directive beam or multiple optimally shaped beams.

5. The antenna of claim 1 wherein the aperture of each lens group is greater than twice a minimum operating wavelength λ of the RF signal.

6. The antenna of claim 5 wherein adjacent lens groups are spaced within one and one half the wavelength λ of each other.

7. The antenna of claim 5 wherein each lens element has an aperture size of approximately half of the wavelength λ.

8. The antenna of claim 1 wherein a plurality of control conductors are provided about a perimeter each radiator unit for providing a unique configurable control voltage to each of the lens elements within the radiator unit.

9. The antenna of claim 1 wherein each lens element comprises at least one unit cell, each unit cell comprising a stack of cell layers, each cell layer comprising a volume of nematic liquid crystal with a controllable dielectric value enabling each cell layer to function as tunable resonator.

10. The antenna of claim 9 wherein each lens element comprises a two dimensional array of the unit cells.

11. The antenna of claim 9 wherein each cell layer comprises:

first and second double sided substrates defining an intermediate region between them, the first substrate having a first microstrip patch formed on a side thereof that faces the second substrate, the second substrate having a second microstrip patch formed on a side thereof that faces the first substrate;

the liquid crystal being located in a liquid crystal embedded substrate between the first microstrip patch and the second microstrip patch in the intermediate region, and wherein the first microstrip patch of each cell layer is electrically connected to a common ground and the second microstrip patch of each cell layer is electrically connected to a common control voltage source.

12. The antenna of claim 11 wherein:

the first microstrip patch of each cell layer is electrically connected to the common ground via a first conductive element extending through the first substrate to a first conductive wire located on an opposite side of the first substrate than the first microstrip patch; and the second microstrip patch of each cell layer is electrically connected to the common control voltage source via a second conductive element extending through the second substrate to a second conductive wire located on an opposite side of the second substrate than the second first microstrip patch;

wherein the first wire and the second wire are substantially RF transparent to the RF signal passing through the cell layer.

13. The antenna of claim 12 wherein the first wire and the second wire are each part of a respective first gridded mesh wire and second gridded mesh wire that extend across the lens element that comprises the unit cell.

14. The antenna of claim 13 where in each unit cell, adjacent cell layers are bonded together by non-conductive adhesive.

15. A method of transmitting RF signals, comprising:

providing a phased array antenna having a two dimensional array of lens enhanced radiator units, each radiator unit comprising: a radiator for generating a radio frequency (RF) signal; and a lens group defining an aperture in a transmission path of the RF signal, the lens group comprising a two dimensional array of individually controllable lens elements enabling a varying transmission phase to be applied to the RF signal across the aperture of the lens group;

generating RF signals at the radiators; and applying control voltages to the lens groups to control a transmission phase of the lens elements across each of the radiator units.

16. The method of claim 15 wherein the control voltages are applied to cause the radiators units to operate in a MIMO mode in which the radiator units operate to form multiple concurrent independent beams.

17. The method of 15 wherein the control voltages are applied to cause the radiators units p to operate in a point-to-point mode in which the radiator units operate collectively to form a single high-gain directive beam or multiple optimally shaped beams.

18. The method of claim 15 wherein each lens element comprises at least one unit cell, each unit cell comprising a stack of cell layers, each cell layer comprising a volume of nematic liquid crystal with a controllable dielectric value enabling each cell layer to function as tunable resonator, wherein the control voltages are applied to control the dielectric values of the cell layers.

19. The method of claim 18 wherein each cell layer comprises:

first and second double sided substrates defining an intermediate region between them, the first substrate having a first microstrip patch formed on a side thereof that faces the second substrate, the second substrate having a second microstrip patch formed on a side thereof that faces the first substrate;

the liquid crystal being located in a liquid crystal embedded substrate between the first microstrip patch and the second microstrip patch in the intermediate region, and wherein the first microstrip patch of each cell layer is electrically connected to a common ground and the second microstrip patch of each cell layer is electrically connected to a common control voltage source, wherein the control voltages are applied using the control voltage source.

20. The method of claim 19 wherein:

the first microstrip patch of each cell layer is electrically connected to the common ground via a first conductive element extending through the first substrate to a first conductive wire located on an opposite side of the first substrate than the first microstrip patch; and the second microstrip patch of each cell layer is electrically connected to the common control voltage source via a second conductive element extending through the second substrate to a second conductive wire located on an opposite side of the second substrate than the second first microstrip patch;

wherein the first wire and the second wire are substantially RF transparent to the RF signal passing through the cell layer.

* * * * *